US006173467B1

(12) United States Patent
Chou

(10) Patent No.: US 6,173,467 B1
(45) Date of Patent: Jan. 16, 2001

(54) MULTIFUNCTIONAL TOOL

(76) Inventor: Paul Chou, P.O. Box 63-247, Taichung (TW)

( * ) Notice: Under 35 U.S.C. 154(b), the term of this patent shall be extended for 0 days.

(21) Appl. No.: 09/348,109

(22) Filed: Jul. 6, 1999

(51) Int. Cl.[7] ..... B25B 15/00
(52) U.S. Cl. ..... 7/165; 81/177.4; 81/490; 7/901
(58) Field of Search ..... 7/165, 901; 81/125, 81/177.4, 438, 490, 451; 294/65.5

(56) References Cited

U.S. PATENT DOCUMENTS 5,381,319 * 1/1995 Shiao ..... 362/120
5,487,576 * 1/1996 DuVivier ..... 294/19.1
5,878,637 3/1999 Liu .
5,896,606 * 4/1999 Huang ..... 7/165
5,918,513 * 7/1999 Ho ..... 81/490

* cited by examiner

*Primary Examiner*—Timothy V. Eley
*Assistant Examiner*—Dung Van Nguyen
(74) *Attorney, Agent, or Firm*—Alan Kamrath

(57) ABSTRACT

A multifunctional tool includes a main body including a connecting end with a socket. A rigid tube has a first end securely and releasably engaged with the socket of the main body. A first hose is telescopically received in the rigid tube and has an end extendible out of a second end of the rigid tube. A second hose is telescopically received in the first hose and has an end extendible out of the first hose. A magnetic member is attached to the end of the second hose for attracting and thus removing a screw from a place difficult to access. The rigid tube can be detached from the main body, and the second hose is then securely and removably held by the main body. A bit carrier carrying a number of bits is pivotally mounted to the main body and pivotable between a storage position inside the main body and an exposed position outside the main body, thereby allowing the user to choose the proper bit.

17 Claims, 5 Drawing Sheets

MULTIFUNCTIONAL TOOL

BACKGROUND OF THE INVENTION

1. Field of the Invention

The present invention relates to a multifunctional tool that includes a telescopic hose with a magnetic member at a distal end thereof for removing a fastener from a place difficult to access. The telescopic hose can be completely retracted into a main body of the multifunctional tool, and a bit can be attached to the main body to function as a driving tool.

2. Description of the Related Art U.S. Pat. No. 5,878,637 to Liu issued on Mar. 9, 1999 discloses a driving tool that includes a barrel, a handle secured to a first end of the barrel for rotating the barrel, and a telescopic pipe engaged in a bore of the barrel and having a first end secured to the handle and a second end extended outward of the bore of the barrel. A magnetic member is secured to the second end of the telescopic pipe, thereby allowing the magnetic member to be extended outward of the bore of the barrel for removing fasteners dropped in a deep hole after unfastening of the fasteners. Nevertheless, function of the driving tool is limited, as the barrel cannot be detached from the handle for operation purpose.

The present invention is intended to provide a multifunctional tool that mitigates and/or obviates the above problems.

SUMMARY OF THE INVENTION

It is a primary object of the present invention to provide a multifunctional tool that includes a telescopic hose with a magnetic member at a distal end thereof for removing a fastener (e.g., a screw) from a place difficult to access. The telescopic hose can be completely retracted into a main body of the multifunctional tool, and a bit can be attached to the main body to function as a driving tool. In addition, a bit carrier is mounted to the main body and is pivotable between a storage position inside the main body and an exposed position such that the user may select the required bit among a plurality of bits carried by the bit carrier.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
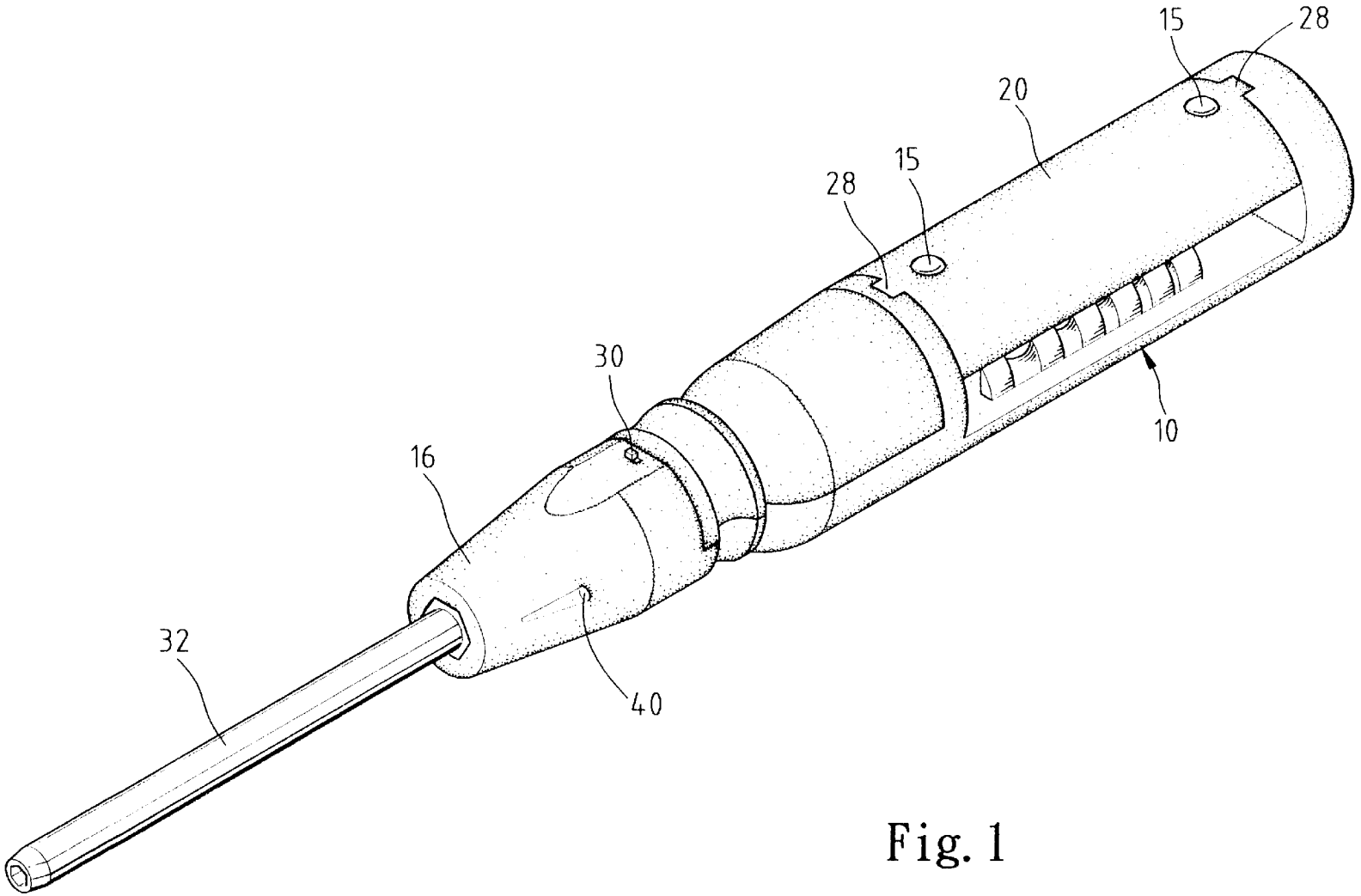
FIG. 1 is a perspective view of a multifunctional tool in accordance with the present invention.
Figure 2:
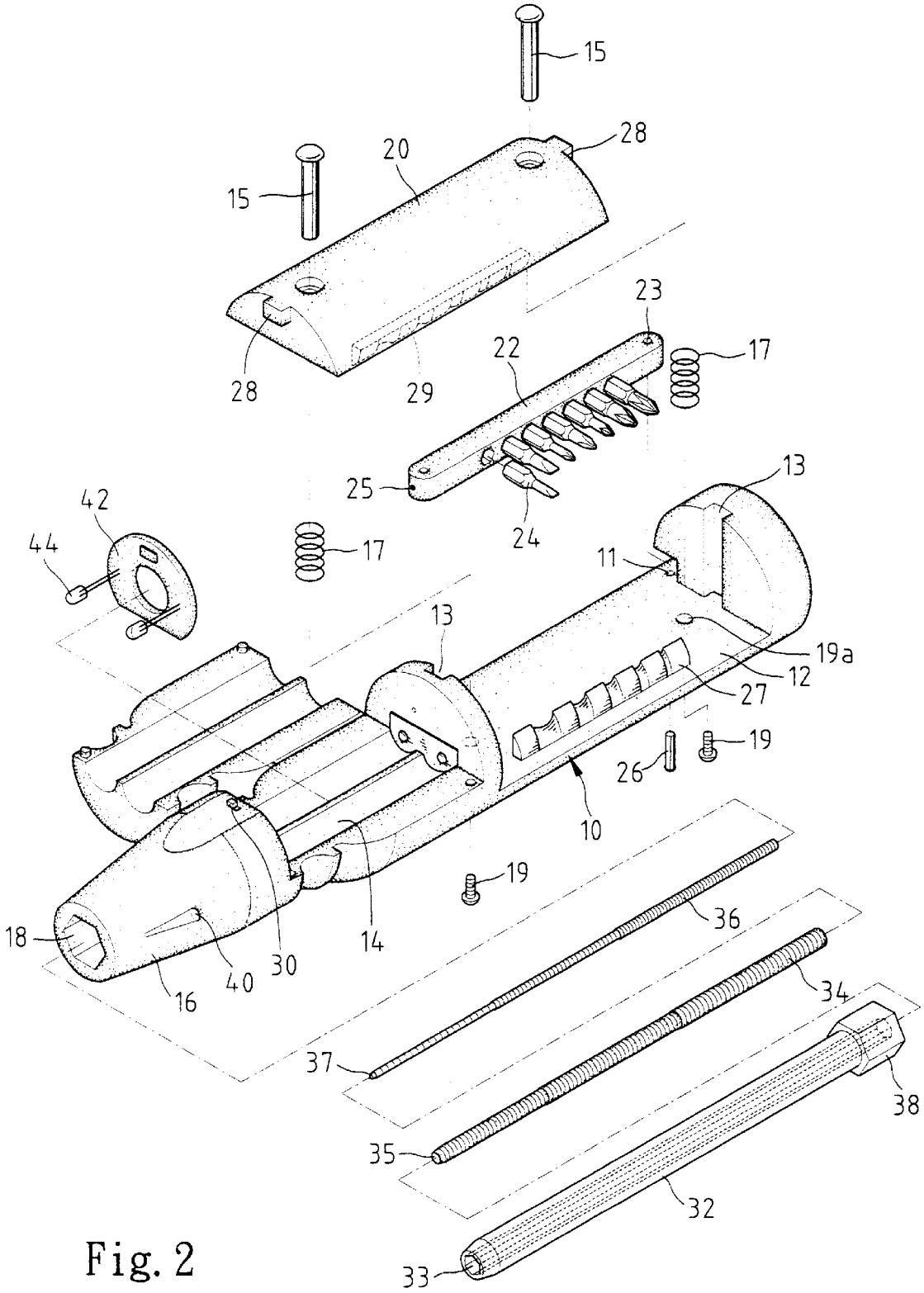
FIG. 2 is an exploded perspective view of the multifunctional tool in accordance with the present invention.

Referring to FIGS. 1 and 2, a multifunctional tool in accordance with the present invention generally includes a main body 10 that includes a first compartment 12 for receiving a bit carrier 22 and a second compartment 14 for receiving a battery unit (not shown). The main body 10 further includes a connecting end 16 with a socket 18. A rigid tube 32 includes a hexagonal engaging end 38 that is securely yet removably received in the socket 18 of the connecting end 16 of the main body 10. A first telescopic hose 34 is telescopically received in the rigid tube 32. The first telescopic hose 34 is extendible out of the rigid tube 32 until a rear end (not labeled) of the hose 34 is stopped by an end opening 33 of the rigid tube 32 that has a diameter smaller than that of the rear end of the hose 34. Similarly, a second telescopic hose 36 is telescopically received in the first telescopic hose 34. The second telescopic hose 36 is extendible out of the first telescopic hose 34 until a rear end (not labeled) of the hose 36 is stopped by an end opening 35 of the rigid tube 32 that has a diameter smaller than that of the rear end (not labeled) of the hose 36. A magnetic member 37 is attached to a distal end of the second telescopic hose 36. The first telescopic hose 34 may be collapsed so as to be completely received in the rigid tube 32, and the second telescopic hose 36 may be collapsed so as to be completely received in the first telescopic hose 34. Each of the first and second telescopic hoses 34 and 36 may include a number of hose sections thereby allowing further collapse.

Two end walls 13 defining the first compartment 12 include aligned groove tracks. An upper lid 20 includes a block 28 on each of two ends thereof so as to be slidable along an associated groove track of end walls 13. Two guide pins 15 are extended through the upper lid 20 and two screws 19 are extended through holes 19a in the main body 10 to securely engage with threaded holes (not shown) in the guide pins 15. A spring 17 is mounted around each guide pin 15 and attached between the upper lid 20 and the main body 10. Wire stripping devices 27 and 29 are provided on the main body 10 and the upper lid 20 such that the wire stripping devices 27 and 29 may perform a wire stripping function when the upper lid 20 is manually pressed. Such arrangement has been disclosed in Applicant's U.S. Pat. No. 08/977,631 filed on Nov. 25, 1997, now U.S. Pat. No. 5,956,789, which is incorporated herein for reference.

A bit carrier 22 has an end pivotally connected to the main body 10 by means of extending a pin 26 through a pin hole 11 in the main body 10 and a pin hole 23 in the bit carrier 22. The bit carrier 22 carries a number of bits 24 A retaining projection 25 is formed on the other end of the bit carrier 22 for releasable engagement with a depression 25*a* (FIG. 6) defined in the main body 10.

Adjacent to the battery unit-receiving compartment 14, a circuit board 42 having number of lamps 44 (e.g., light emitting diodes) thereon is mounted in the main body. The lamps 44 are located in lamp holes 40 in the main body 10. A switch 30 is provided to turn on/off the lamps 44.

Figure 3:
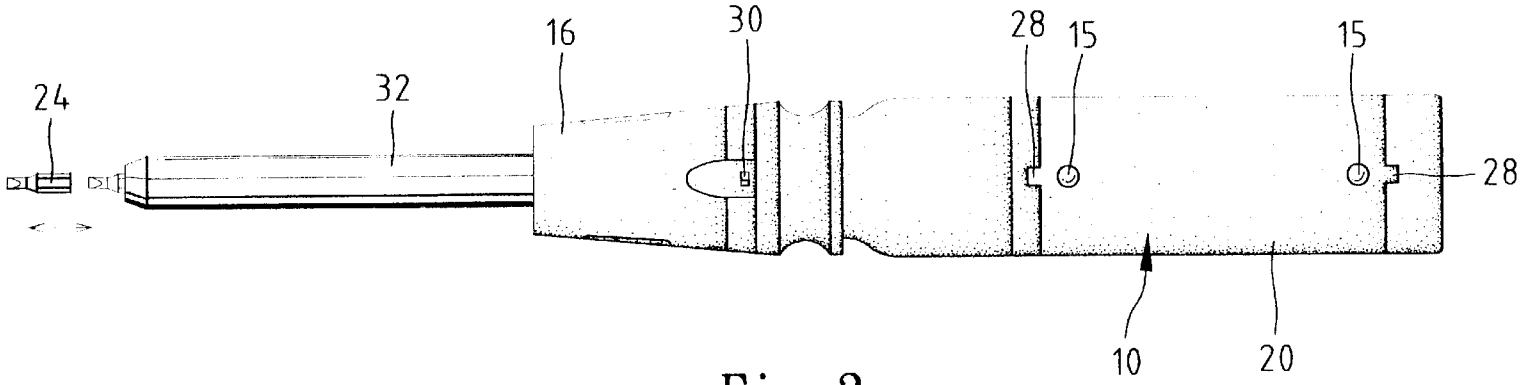
FIG. 3 is a top view of the multifunctional tool in accordance with the present invention, illustrating insertion of a bit.
Figure 6:
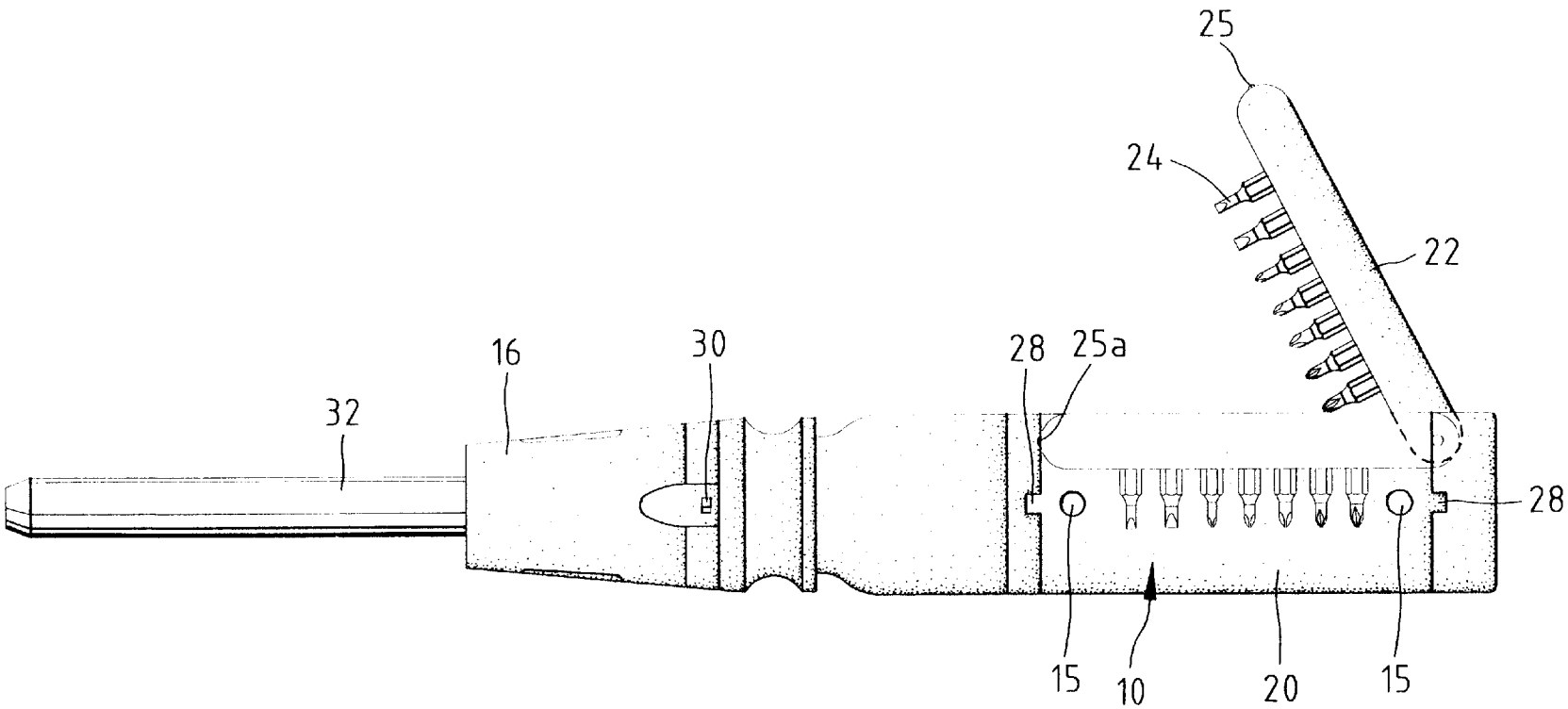
FIG. 6 is a top view of the multifunctional tool, wherein a bit carrier is pivoted to an exposed position.

In use, referring to FIG. 3, the first and second telescopic hoses 34 and 36 are completely collapsed and thus hidden inside the rigid tube 32. The user may attach a bit 24 to the end opening 33 of the rigid tube 32 and thus function as a driving tool. Referring to FIG. 6, the bit carrier 22 may be pivoted to the exposed position when required, thereby allowing the user to find the proper bit 24 in an easier way.

Figure 4:
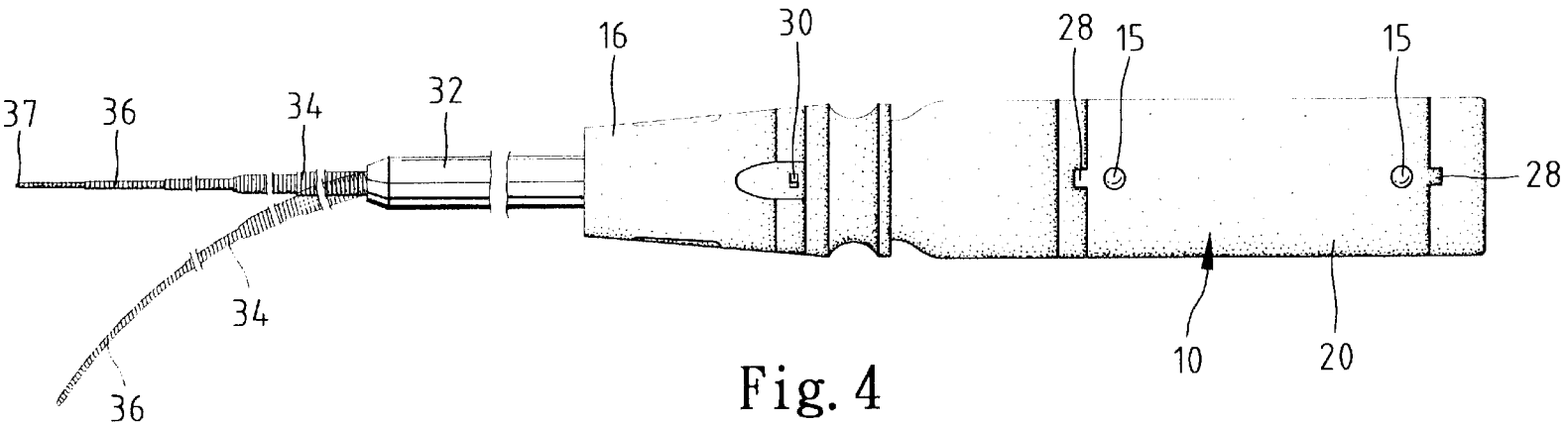
FIG. 4 is a top view similar to FIG. 3, wherein a hose arrangement is extended outward of a rigid tube of the main body.
Figure 5:
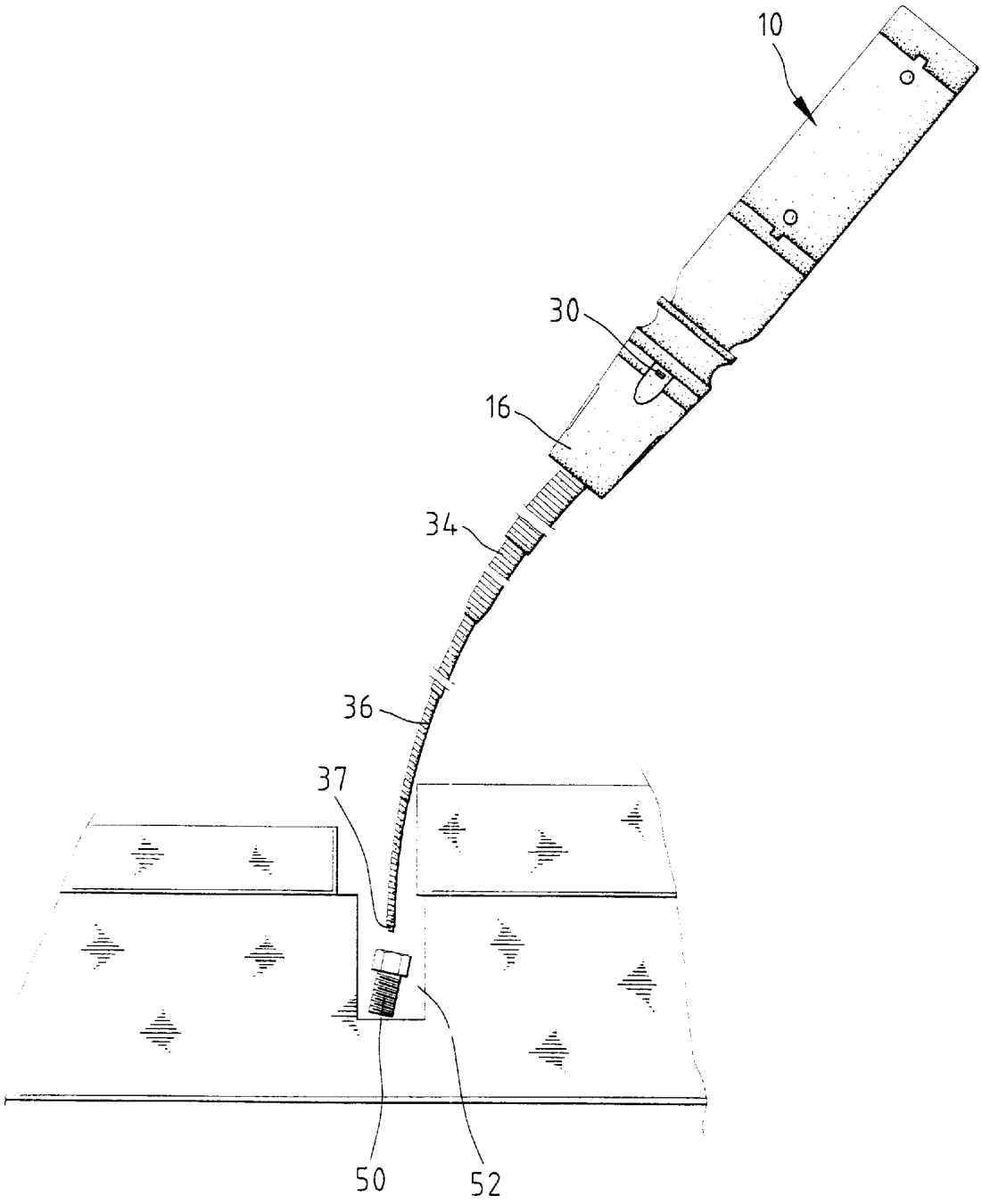
FIG. 5 is a schematic view illustrating use of the hose arrangement of the multifunctional tool, wherein the rigid tool has been removed.

If the fastener (e.g., a screw 50, see FIG. 5) falls into a deep hole 52 that is difficult to access, the first and second telescopic hoses 34 and 36 are extended (FIG. 4) to remove the screw 50. In an alternative way to remove the screw 50, the rigid tube 32 is detached from the main body 10, as shown in FIG. 5. The first and second telescopic hoses 34 and 36 are extended outward to remove the screw 50 by means of magnetic attraction provided by the magnetic member 37. Such action can be easily achieved, as the first and second telescopic hoses 34 and 36 are flexible. When not in use, the first and second telescopic hoses 34 and 36 can be collapsed and can be hidden inside the main body 10. It is appreciated that the main body 10 securely holds the rear end of the first telescopic hose 34 if the rigid tube 32 is removed.

According to the above description, it is appreciated that the multifunctional tool in accordance with the present invention is more versatile, as the rigid tube 32 can be removed without affecting the screw removing function. In addition, the bit carrier 22 allows easy and rapid replacement and/or selection of the bits 24. Furthermore, lamps 44 are provided to illuminate when necessary.

Although the invention has been explained in relation to its preferred embodiment, it is to be understood that many other possible modifications and variations can be made without departing from the spirit and scope of the invention as hereinafter claimed.

What is claimed is:

1. A multifunctional tool, comprising:

a main body including a connecting end with a socket, a battery-receiving compartment defined therein and a lamp means mounted thereto, a rigid tube having a first end securely and releasably engaged with the socket of the main body and a second end, a first hose telescopically received in the rigid tube and having an end extendible out of the second end of the rigid tube, a second hose telescopically received in the first hose and having an end extendible out of the first hose, the first hose being securely and removably held by the main body when the rigid tube is detached from the main body, and a magnetic member attached to the end of the second hose.

2. The multifunctional tool as claimed in claim 1, wherein the main body comprises a compartment for receiving a bit carrier carrying a plurality of bits, and wherein the second end of the rigid tube releasably engages one of the bits.

3. The multifunctional tool as claimed in claim 2, wherein the bit carrier includes a first end pivotally connected to the main body and a second end with a retaining projection, and wherein the main body includes a depression for releasably engaging with the retaining projection, thereby allowing the bit carrier to be pivotable between a storage position in the compartment and an exposed position outside the main body.

4. The multifunctional tool as claimed in claim 1, wherein the first hose includes a plurality of telescopically connected hose sections.

5. The multifunctional tool as claimed in claim 1, wherein the second hose includes a plurality of telescopically connected hose sections.

6. A multifunctional tool, comprising, in combination:

a main body including a connecting end with a socket, a battery-receiving compartment defined therein and a lamp means mounted thereto, a rigid tube having a first end securely engaged with the socket of the main body and having a second end, a first telescopic member telescopically received in the rigid tube and having an end extendible out of the second end of the rigid tube, a second telescopic member telescopically received in the first telescopic member and having an end extendible out of the first telescopic member, and a magnetic member attached to the end of the second telescopic member.

a magnetic member attached to the end of the second hose.

7. The multifunctional tool as claimed in claim 6, wherein the first end of the rigid tube is releasably engaged with the socket of the main body; and wherein the first telescopic member is securely and removably held by the main body when the rigid tube is detached from the main body.

8. The multifunctional tool as claimed in claim 7, wherein the first telescopic member is a hose and the second telescopic member is a hose.

9. The multifunctional tool as claimed in claim 8, wherein the second hose includes a plurality of telescopically connected hose sections.

10. The multifunctional tool as claimed in claim 9, wherein the first hose includes a plurality of telescopically connected hose sections.

11. The multifunctional tool as claimed in claim 8, wherein the first hose includes a plurality of telescopically connected hose sections.

12. The multifunctional tool as claimed in claim 6, wherein the first telescopic member is a hose and the second telescopic member is a hose.

13. The multifunctional tool as claimed in claim 12, wherein the second hose includes plurality of telescopically connected hose sections.

14. The multifunctional tool as claimed in claim 13, wherein the first hose includes a plurality of telescopically connected hose sections.

15. The multifunctional tool as claimed in claim 12, wherein the first hose includes a plurality of telescopically connected hose sections.

16. The multifunctional tool as claimed in claim 6, wherein the main body comprises a compartment for receiving a bit carrier carrying a plurality of bits, and wherein the second end of the rigid tube releasably engages one of the bits.

17. The multifunctional tool as claimed in claim 16, wherein the bit carrier includes a first end pivotally connected to the main body and a second end with a retaining projection, and wherein the main body includes a depression for releasably engaging with the retaining projection, thereby allowing the bit carrier to be pivotable between a storage position in the compartment and an exposed position outside the main body.

* * * * *